US011472190B2

(12) United States Patent
Karita

(10) Patent No.: US 11,472,190 B2
(45) Date of Patent: Oct. 18, 2022

(54) PRINTING APPARATUS

(71) Applicant: CANON KABUSHIKI KAISHA, Tokyo (JP)

(72) Inventor: Seiichiro Karita, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 17/193,742

(22) Filed: Mar. 5, 2021

(65) Prior Publication Data

US 2021/0300051 A1 Sep. 30, 2021

(30) Foreign Application Priority Data

Mar. 31, 2020 (JP) ..... JP2020-063664

(51) Int. Cl.
*B41J 2/175* (2006.01)

(52) U.S. Cl.
CPC ..... *B41J 2/17523* (2013.01); *B41J 2/17506* (2013.01); *B41J 2/17596* (2013.01)

(58) Field of Classification Search
CPC .... B41J 2/175; B41J 2/17503; B41J 2/17506; B41J 2/17509; B41J 2/17513; B41J 2/1752; B41J 2/17523; B41J 2/17596
See application file for complete search history.

(56) References Cited

U.S. PATENT DOCUMENTS

| | | | | |
|---|---|---|---|---|
| 5,051,759 | A | 9/1991 | Karita et al. | 347/87 |
| 5,216,446 | A | 6/1993 | Satoi et al. | 347/65 |
| 5,237,342 | A | 8/1993 | Saikawa et al. | 347/87 |
| 5,280,299 | A | 1/1994 | Saikawa et al. | 347/87 |
| 5,500,666 | A | 3/1996 | Hattori et al. | 347/87 |
| 5,502,479 | A | 3/1996 | Ishinaga et al. | 347/93 |
| 5,619,238 | A | 4/1997 | Higuma et al. | 347/86 |
| 5,623,287 | A | 4/1997 | Saikawa et al. | 347/47 |
| 5,629,728 | A | 5/1997 | Karita et al. | 347/87 |
| 5,732,751 | A * | 3/1998 | Schmidt | B41J 2/17506 141/2 |
| 5,917,514 | A | 6/1999 | Higuma et al. | 347/29 |
| 5,949,459 | A * | 9/1999 | Gasvoda | B41J 2/17513 347/86 |
| 6,123,420 | A | 9/2000 | Higuma et al. | 347/86 |
| 6,250,752 | B1 | 6/2001 | Tajima et al. | 347/92 |
| 6,286,945 | B1 | 9/2001 | Higuma et al. | 347/86 |
| 6,290,344 | B1 | 9/2001 | Saikawa et al. | 347/86 |
| 6,332,673 | B1 | 12/2001 | Higuma et al. | 347/86 |
| 6,474,801 | B2 | 11/2002 | Higuma et al. | 347/86 |
| 6,688,735 | B2 | 2/2004 | Higuma et al. | 347/86 |
| 6,796,643 | B2 | 9/2004 | Higuma et al. | 347/85 |
| 7,008,050 | B2 * | 3/2006 | Childers | B41J 25/34 347/85 |
| 7,784,923 | B2 * | 8/2010 | Ishizawa | B41J 2/1752 347/85 |

(Continued)

FOREIGN PATENT DOCUMENTS

JP 2019-025794 2/2019

*Primary Examiner* — Anh T Vo
(74) *Attorney, Agent, or Firm* — Venable LLP

(57) ABSTRACT

An object of the present disclosure is to reduce liquid leakage resulting from detachment of a cartridge. One embodiment of the present invention is a printing apparatus including: a cartridge having a casing for storing liquid; and an attachment unit configured to attach the cartridge, and the cartridge has a hollow needle that connects with the attachment unit.

13 Claims, 4 Drawing Sheets

(56) References Cited

U.S. PATENT DOCUMENTS

| | | | | |
|---|---|---|---|---|
| 9,914,308 | B2 | 3/2018 | Yamada et al. | B41J 2/1404 |
| 9,975,340 | B2 | 5/2018 | Karita et al. | B41J 2/14024 |
| 9,981,464 | B2 | 5/2018 | Karita et al. | B41J 2/155 |
| 10,005,287 | B2 | 6/2018 | Yamada et al. | B41J 2/14072 |
| 10,195,868 | B2 | 2/2019 | Yamada et al. | B41J 2/175 |
| 10,471,711 | B2 | 11/2019 | Karita et al. | B41J 2/16585 |
| 2017/0197426 | A1 | 7/2017 | Nagai et al. | B41J 2/1404 |

* cited by examiner

PRINTING APPARATUS

BACKGROUND OF THE INVENTION

Field of the Invention

The present disclosure relates to a printing apparatus that attaches an ink cartridge.

Description of the Related Art

As an example of a liquid consuming apparatus, there is known an ink jet printing apparatus in which an ink cartridge is attachable to and detachable (removable) from an attachment unit. In the ink jet printing apparatus, for example, a hollow needle comprised by the attachment unit is inserted into an ink supply port of the ink cartridge. Due to this, the ink within the ink cartridge is supplied to a print head via the ink supply port and the needle. Further, on the periphery of the ink supply port, a seal portion consisting of rubber and the like is arranged. By the seal portion, the gap between the ink supply port and the needle is sealed. Due to this, the ink is prevented from leaking from the gap.

However, in the process of detaching the ink cartridge from the attachment unit, there is such a problem that the ink within the ink cartridge or the needle is pulled by the needle or the seal portion and the ink leaks to the outside in a case where the contact between the needle and the seal portion is cut off. As a technique to solve this problem, there exists a technique disclosed in Japanese Patent Laid-Open No. 2019-25794. In Japanese Patent Laid-Open No. 2019-25794, the configuration is designed in which the ink supply port is covered with a cover and an interfering unit configured to stop the ink cartridge at a specified position in a case where the ink cartridge is detached and the needle top is accommodated between a seal member and an ink receiving portion. With the configuration such as this, it is possible for a cap for fixing the seal member to receive the ink having leaked from the ink supply port or the needle.

SUMMARY OF THE INVENTION

However, with the configuration of Japanese Patent Laid-Open No. 2019-25794, there is a possibility that the ink that gathers in a space surrounded by the needle, the seal member, and a valve leaks in a case where the contact between the needle tip and the seal portion in the seal member is cut off by the detachment of the ink cartridge.

Consequently, in view of the above-described problem, an object of one embodiment of the present invention is to reduce the leakage of liquid resulting from detachment of an ink cartridge.

One embodiment of the present invention is a printing apparatus including: a cartridge having a casing for storing liquid; and an attachment unit configured to attach the cartridge, and the cartridge has a hollow needle that connects with the attachment unit.

Further features of the present invention will become apparent from the following description of exemplary embodiments with reference to the attached drawings.

DESCRIPTION OF THE EMBODIMENTS

In the following, with reference to the attached drawings, embodiments of the present invention are explained in detail. However, components described in the following are merely exemplary and not intended to limit the scope of the present invention to those. Further, all technical features described in the following are not necessarily indispensable to the solution of the present invention.

First Embodiment

<Attachment Method of Ink Cartridge>

In the following, a method of attaching an ink cartridge 100 to a liquid printing apparatus in the present embodiment is explained by using FIG. 1A and FIG. 1B.

Figure 1A:
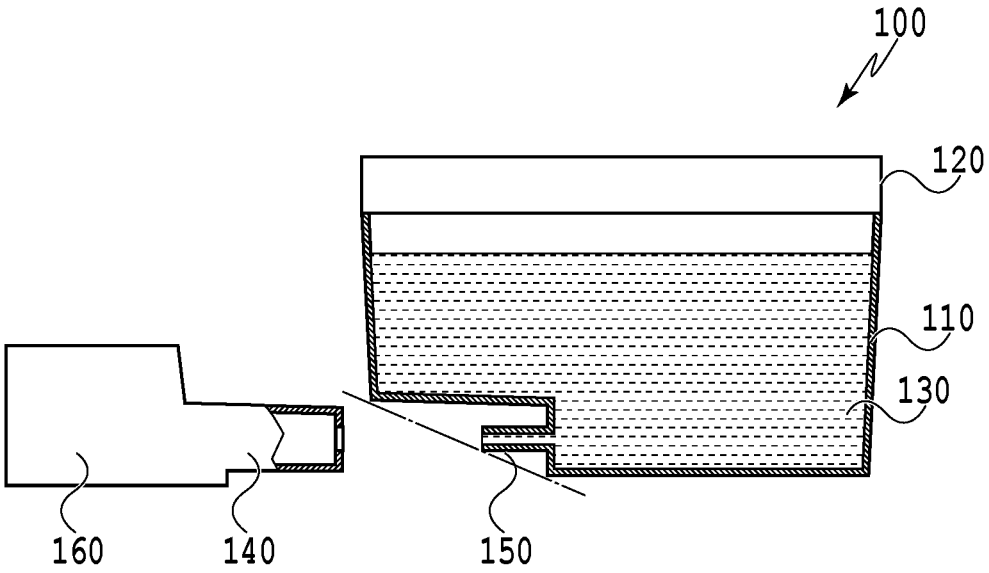
FIG. 1A and FIG. 1B are each a diagram showing an attachment method of an ink cartridge.
Figure 1B:
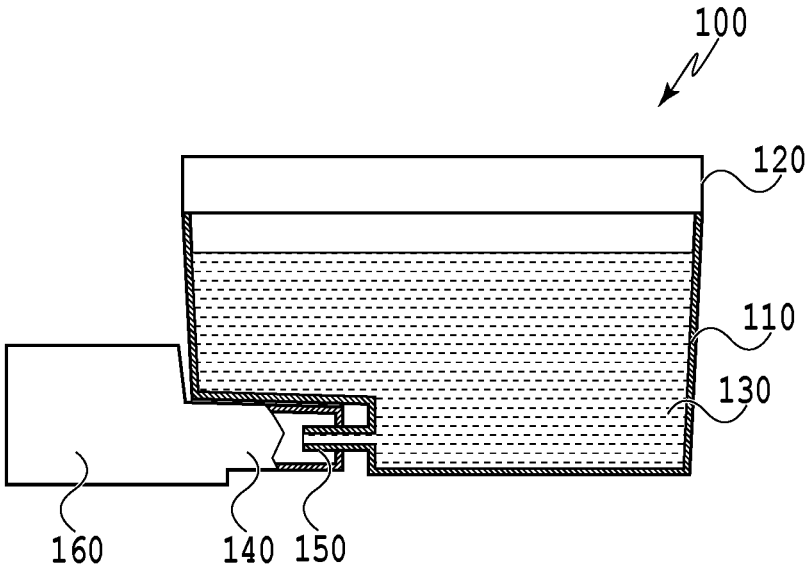

As shown in FIG. 1A and FIG. 1B, the ink cartridge 100 in which ink 130 is stored is mounted on a liquid printing apparatus (not shown schematically) and attached to an ink storage unit 160 configured to store ink. The ink storage unit 160 functions as an intermediary member that supplies the ink 130 stored in a print head of the liquid printing apparatus by the ink cartridge 100 being attached. The ink cartridge 100 has a casing 110, a lid 120, and a needle 150. Inside the casing 110, the ink 130 is stored and in the lid 120, an air communication port (not shown schematically) is provided. The needle 150 for connecting with the printing apparatus has a valve having a valve spring structure or the like. To the ink storage unit 160, a supply unit 140 configured to function as a connecting unit with the needle 150 and supply ink to the ink storage unit 160 is connected. Here, explanation is given on the assumption that the liquid printing apparatus is an ink jet printing apparatus (hereinafter, abbreviated to printing apparatus), but the liquid is not limited to ink.

FIG. 1A shows the state before the ink cartridge 100 is attached to the printing apparatus and FIG. 1B shows the state after the ink cartridge 100 is attached to the printing apparatus. By inserting (sticking) the needle 150 that is the protruding portion of the ink cartridge 100 into the supply unit 140, an ink flow path is implemented, in which ink flows between the ink cartridge 100 and the ink storage unit 160 via the supply unit 140. As a result of that, ink is supplied from the ink cartridge 100 to the ink storage unit 160. It is desirable to install the needle 150 so as to be located inside a space that is formed in a case where the corner portions of the external shape of the ink cartridge 100 are connected as indicated by a broken line in FIG. 1A. By designing the configuration such as this, it is possible to suppress the needle from being caught by an external object, and therefore, it is possible to protect the needle. In the present specification, one end of the two ends of the needle 150, which is closer to the casing 110 is called "base end (of the needle)" and the other end "tip (of the needle)".

<Configuration of Attachment Unit>

In the following, the attachment unit of the ink cartridge 100 in the present embodiment, specifically, the configuration for connecting the ink cartridge 100 and the ink storage unit 160 is explained by using FIG. 2.

Figure 2:
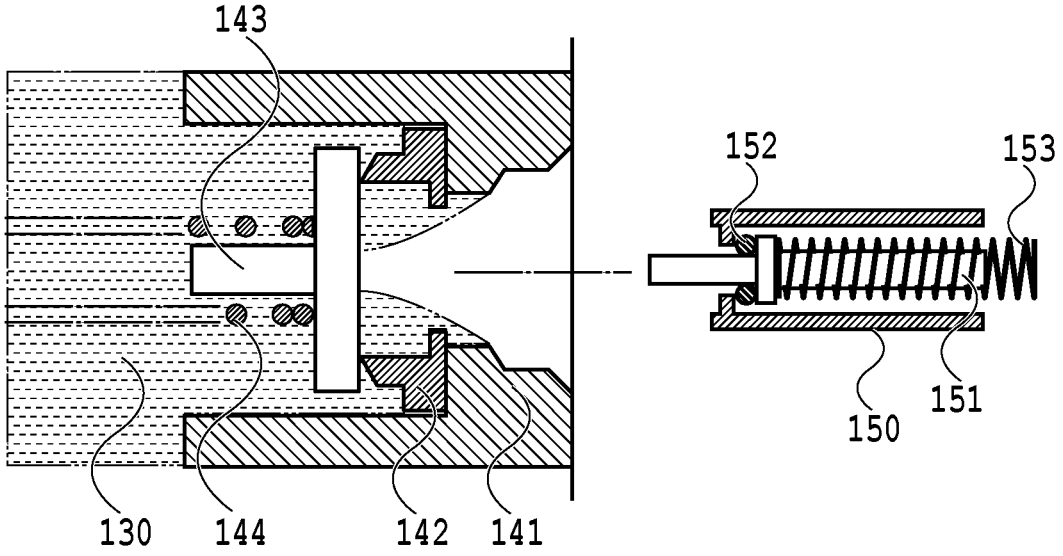
FIG. 2 is a cross-sectional diagram of an attachment unit of an ink cartridge.

As shown in FIG. 2, the ink cartridge 100 has a valve spring mechanism inside the hollow needle 150 as a mechanism for preventing the ink 130 from flowing out to the outside. This valve spring mechanism includes a valve 151, a seal member 152, and a coil spring 153. In the supply unit 140 on the side of the ink storage unit 160 also, a valve spring mechanism including a valve 143, a seal member 142, and a coil spring 144 is provided similarly. Further, in the present embodiment, as shown in FIG. 2, as regards the position in the direction in which needle 150 extends, the configuration is such that the convex shape of the tip of the valve 151 protrudes from the outer wall of the needle 150.

In a case where the ink cartridge 100 is not attached to the printing apparatus, by the coil spring 153 within the needle 150 pressing the valve 151, the seal member 152 is pressed. By the pressed seal member 152 coming into contact with the convex portion of the inner wall of the needle 150, sealing within the needle 150 is performed.

In a case where the ink cartridge 100 is attached to the printing apparatus, first, the tip in the convex shape in the valve 151 on the side of the cartridge 100 comes into contact with the valve 143 on the side of the supply unit 140 and the tip is pressed. Due to this, the seal member 152 within the needle 150 separates from the convex portion of the inner wall of the needle 150 and as a result that, the sealing within the needle 150 is released and it is made possible to supply ink from the ink cartridge 100 to the ink storage unit 160.

<Insertion and Removal of Ink Cartridge>

In the following, attachment of the ink cartridge 100 to the ink storage unit 160 and subsequent detachment of the ink cartridge 100 from the ink storage unit 160 (called all together insertion and removal of ink cartridge) are explained by using FIG. 3A to FIG. 3E. FIG. 3A to FIG. 3E are each an enlarged cross-sectional diagram showing a state at the time of insertion and removal of the ink cartridge 100.

Figure 3A:
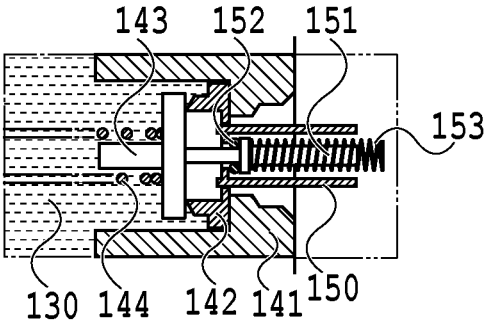
FIG. 3A to FIG. 3E are diagrams explaining insertion and removal of an ink cartridge.

FIG. 3A shows the state immediately after the needle 150 of the ink cartridge 100 is inserted into the supply unit 140. In order to make it easy to attach the ink cartridge 100, a cover 141 of the tip of the supply unit 140 fixes the seal member 142. Further, the cover 141 has a shape of an opening whose diameter is larger than that of the needle 150 and plays a role of a guide mechanism that guides the ink cartridge 100 at the time of attachment of the ink cartridge 100. In the state immediately after the insertion of the needle 150, by the outer circumference of the needle 150 of the ink cartridge 100 coming into contact with the inside of the seal member 142 within the supply unit 140, the supply unit 140 is sealed and the protruding tip of the valve 151 within the needle 150 comes into contact with the valve 143. At this time, the space surrounded by the valve 143, the outer wall of the needle 150, and the seal member 142 is in the hermetically sealed state.

Figure 3B:
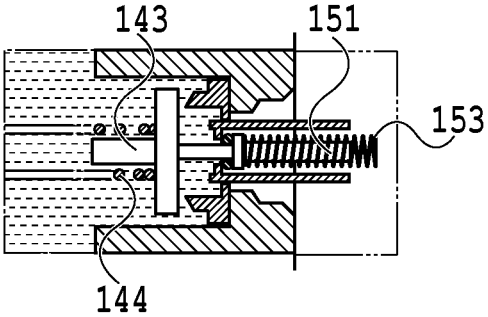

FIG. 3B shows the state where the ink cartridge 100 is further pushed in from the state in FIG. 3A. Compared to the coil spring 153 on the side of the needle 150, the coil spring 144 on the side of the supply unit 140 is weak. Because of this, the configuration is such that the valve 143 on the side of the supply unit 140 opens before the valve 151 on the side of the needle 150 opens in the insertion process as shown in FIG. 3B.

Figure 3C:
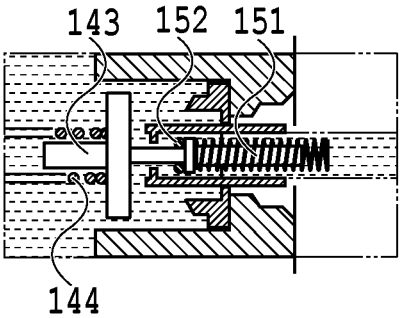

FIG. 3C shows the state where the ink cartridge 100 is further pushed in from the state in FIG. 3B. As shown in FIG. 3C, the valve 151 on the side of the needle 150 opens and at the same time, the valve 143 on the side of the supply unit 140 is further pushed in from the state in FIG. 3B and moves. By the valve 151 moving and opening, it is made possible for the ink 130 within the ink cartridge 100 to move to the ink storage unit 160 via the supply unit 140.

Figure 3D:
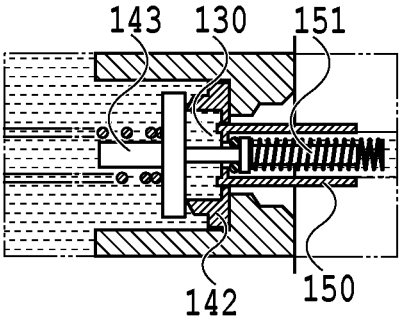

FIG. 3D shows the state where the removal of the ink cartridge 100 is on the way from the state in FIG. 3C. At the time of the removal of the ink cartridge 100, the valve in the ink supply unit and the valve in the needle 150 operate in the order opposite to that at the time of the insertion of the ink cartridge 100. As regards the state in FIG. 3D, the position of each component is the same as that in FIG. 3A, but FIG. 3D differs from FIG. 3A in that the hermetically sealed space surrounded by the valve 143, the needle 150, and the seal member 142 is filled with ink.

Figure 3E:
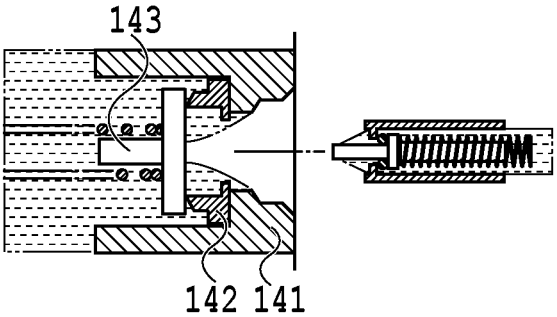
Figure 4A:
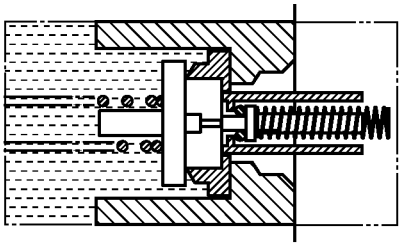
FIG. 4A to FIG. 4E are diagrams explaining insertion and removal of an ink cartridge.
Figure 4B:
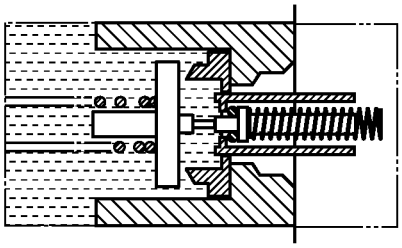
Figure 4C:
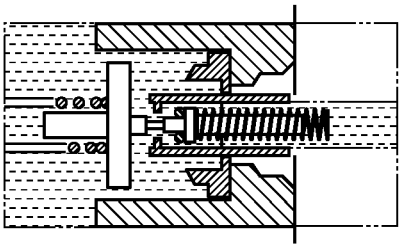
Figure 4D:
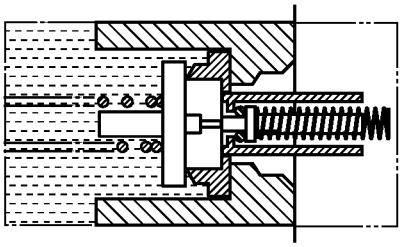
Figure 4E:
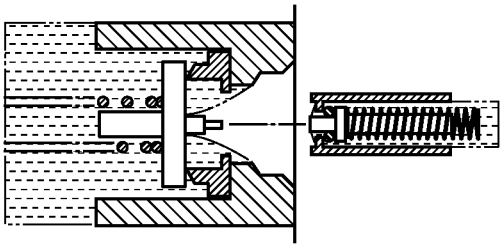

FIG. 3E shows the state where the needle 150 of the ink cartridge 100 is removed from the supply unit 140. As shown in FIG. 3E, in a case where the ink cartridge 100 is detached, the ink 130 having gathered in the hermetically sealed space described previously shown in FIG. 3D stagnates in the vicinity of the opening of the supply unit 140, and therefore, it is possible to prevent the ink 130 from flying off to the outside of the cover 141. However, in a case where the detachment of the ink cartridge 100 is performed repeatedly several times, the ink that stagnates in the vicinity of the opening of the supply unit 140 accumulates, and therefore, there is a possibility that the ink 130 flies off to the outside of the cover 141.

In such a case, the ink 130 flies off to the outside of the cover 141 and drops onto the bottom of the supply unit 140 mounted on the printing apparatus. However, by taking measures in advance, such as arrangement of an absorbent material in the vicinity of the supply unit 140 in preparation for a case where the ink 130 drops onto the bottom of the supply unit 140, the ink 130 does not flow out to the outside of the printing apparatus. On the other hand, the amount of ink sticking to the needle 150 of the ink cartridge 100 at the time of the detachment of the ink cartridge 100 is very small because of the shape of the needle 150 itself. Consequently, it is rare that the ink sticking to the ink cartridge 100 drops at the time of the detachment of the ink cartridge 100.

Second Embodiment

FIG. 4A to FIG. 4E show an embodiment in which the convex shape of the tip of the valve 151 on the side of the needle 150 and the shape of the tip of the valve 143 on the side of the supply unit 140 are changed as an embodiment different from the embodiment described previously. In the present embodiment, as shown in FIG. 4A to FIG. 4E, as regards the position in the direction in which the needle 150 extends, the configuration is such that the convex shape of the tip of the valve 151 does not protrude from the outer wall of the needle 150. By designing the configuration such as this, it is possible to reduce the amount of ink sticking to the needle 150 at the time of the detachment compared to that in the embodiment described previously. Further, by designing the configuration such as this, the possibility that ink leaks from the ink cartridge 100 in a case where an object hits the tip portion of the needle 150 becomes fainter than that in the embodiment described previously (see FIG. 2, FIG. 3A to FIG. 3E). In response to designing the configuration in which the convex shape of the tip of the valve 151 does not protrude from the outer wall of the needle 150, the configuration is designed in which a protruding shape is provided on the side of the valve 143 and the valve 151 is pressed by the protruding shape.

The dimensions of the tip portion of the needle 150 and the protruding shape on the side of the valve 143 are set so that each valve shown in FIG. 4A to FIG. 4E operates in the same manner as that in the first embodiment (see FIG. 3A to FIG. 3E) at the time of the attachment and detachment of the ink cartridge 100. FIG. 4A to FIG. 4E are diagrams corresponding to FIG. 3A to FIG. 3E, respectively, and each valve shown in FIG. 4A to FIG. 4E operates at the same opening/closing timing as that in the first embodiment.

According to the present embodiment, the size of the portion at which there is a possibility that ink gathers at the needle tip portion is small compared to that of the first embodiment, and therefore, it is possible to further suppress the ink leakage at the time of detaching the ink cartridge 100.

According to one embodiment of the present invention, it is possible to reduce the liquid leakage resulting from detachment of a cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-063664, filed Mar. 31, 2020, which is hereby incorporated by reference wherein in its entirety.

What is claimed is:

1. A printing apparatus comprising:

a cartridge having a casing for storing liquid; and an attachment unit configured to attach the cartridge, wherein the cartridge has a hollow needle that connects with the attachment unit, wherein as a valve spring mechanism that prevents liquid from leaking to the outside, the attachment unit has:

a first valve;

a first seal member that seals a connecting unit between the cartridge and the attachment unit in a case where the cartridge is attached; and a first coil spring, and wherein as a valve spring mechanism that prevents liquid from leaking to the outside, the needle has:

a second valve;

a second seal; and a second coil spring.

2. The printing apparatus according to claim 1, wherein the first coil spring is weaker than the second coil spring.

3. The printing apparatus according to claim 1, wherein a tip of the second valve is a convex shape.

4. The printing apparatus according to claim 3, wherein a protruding shape is not provided at a tip of the first valve and as regards a position in a direction in which the needle extends, the convex shape of the second valve protrudes from an outer wall of the needle.

5. The printing apparatus according to claim 3, wherein a protruding shape is provided at the tip of the first valve and as regards a position in a direction in which the needle extends, the convex shape of the second valve does not protrude from an outer wall of the needle.

6. The printing apparatus according to claim 1, wherein the attachment unit further has a cover for fixing the first seal member.

7. The printing apparatus according to claim 6, wherein at the time of detaching the cartridge, liquid gathers in a space surrounded by the first valve, the first seal member, and an outer wall of the needle.

8. The printing apparatus according to claim 7, wherein after detachment of the cartridge, liquid stagnates inside the cover.

9. The printing apparatus according to claim 6, wherein a diameter of an opening configured by the cover is larger than a diameter of the needle.

10. The printing apparatus according to claim 9, wherein the cover plays a role as a guide mechanism that guides the cartridge at the tome of attachment of the cartridge.

11. The printing apparatus according to claim 1, wherein a base end that is one of two ends of the needle and closer to the casing is communicated with the casing and in a case where the cartridge is attached to the attachment unit, liquid stored in the casing flows in order of the base end, a tip that is one end of the needle and not the based end, and the attachment unit.

12. The printing apparatus according to claim 1, wherein the needle is arranged inside a space that is formed in a case where corner portions of an external shape of the cartridge are connected.

13. A printing apparatus comprising:

a cartridge having a casing for storing liquid; and an attachment unit configured to attach the cartridge, wherein the cartridge has a first valve, a first seal member, and a first coil spring as a first valve spring mechanism that prevents liquid from leaking to the outside and the attachment unit has a second valve, a second seal member, and a second coil spring as a second valve spring mechanism that prevents liquid from leaking to the outside.

* * * * *